United States Patent [19]

Akamatsu

[11] 4,114,217

[45] Sep. 19, 1978

[54] DIE ASSEMBLY

[75] Inventor: Motoji Akamatsu, Hirakata, Japan

[73] Assignee: Akamatsu Alloy Tool Co., Ltd., Hirakata, Japan

[21] Appl. No.: 834,387

[22] Filed: Sep. 19, 1977

[30] Foreign Application Priority Data

Sep. 21, 1976 [JP] Japan ..... 51-128120[U]

[51] Int. Cl.[2] ..... B21J 13/02

[52] U.S. Cl. ..... 10/85; 10/86 F; 72/352

[58] Field of Search ..... 72/352; 10/24, 85, 86 F

[56] References Cited

U.S. PATENT DOCUMENTS

| | | | |
|---|---|---|---|
| 1,961,442 | 6/1934 | Johnson | 10/85 X |
| 3,191,204 | 6/1965 | Mclellen | 10/24 |
| 3,937,053 | 2/1976 | Akamatsu | 10/24 X |

*Primary Examiner*—Leon Gilden
*Attorney, Agent, or Firm*—Bacon & Thomas

[57] ABSTRACT

A die assembly comprising a reinforcement case formed with a tapered bore, a forming die inserted into the tapered bore from therebelow, and a stock die supporting the forming die in fitting contact with the bottom of the forming die and formed at its lower portion with a guide stem of reduced diameter. The guide stem extends downward through the center of a threaded bore formed in the lower portion of the reinforcement case. A pushing-up member having a center bore through which the guide stem extends freely movably is screwed in the threaded bore of the reinforcement case and supports the stock die. The forming die and the stock die are formed with knockout pin passageways in alignment with each other.

4 Claims, 2 Drawing Figures

DIE ASSEMBLY

BACKGROUND OF THE INVENTION

Die assemblies comprising a forming die of cemented carbides fitted in a reinforcement case are generally used in the press forming of metal parts. Japanese Patent Application Disclosure No. SHO. 50-55972, for example, discloses a die assembly in which a die is detachably fitted into a reinforcement case by being pushed up with a member screwed into a threaded bore in the reinforcement case so as to render the die replaceable in the event of wear or damage.

However, such die assemblies are extremely difficult to make because the threaded outer periphery of the shank portion of the pushing-up member, the knockout pin passageway internally extending through the pushing-up member and the threaded bore of the reinforcement case must be concentric with high accuracy. If these portions are not concentric, the knockout pin passageways formed in the forming die and in the pushing-up member respectively will not be concentric with each other, giving rise to the problems that the knockout pin will not be smoothly slidable or an axial compressive force acting during the forming operation will fracture the knockout pin.

SUMMARY OF THE INVENTION

An object of this invention is to provide a die assembly which included a pushing-up member formed with a center bore loosely fitting in the lower portion of a stock die to eliminate the necessity for the accurate alignment of the pushing-up member and which is rendered extremely easy to make.

Another object of this invention is to provide a die assembly in which a forming die is detachably mounted in a reinforcement case and is therefore easily replaceable when damaged or fractured.

DETAILED DESCRIPTION OF THE INVENTION

Figure 2:
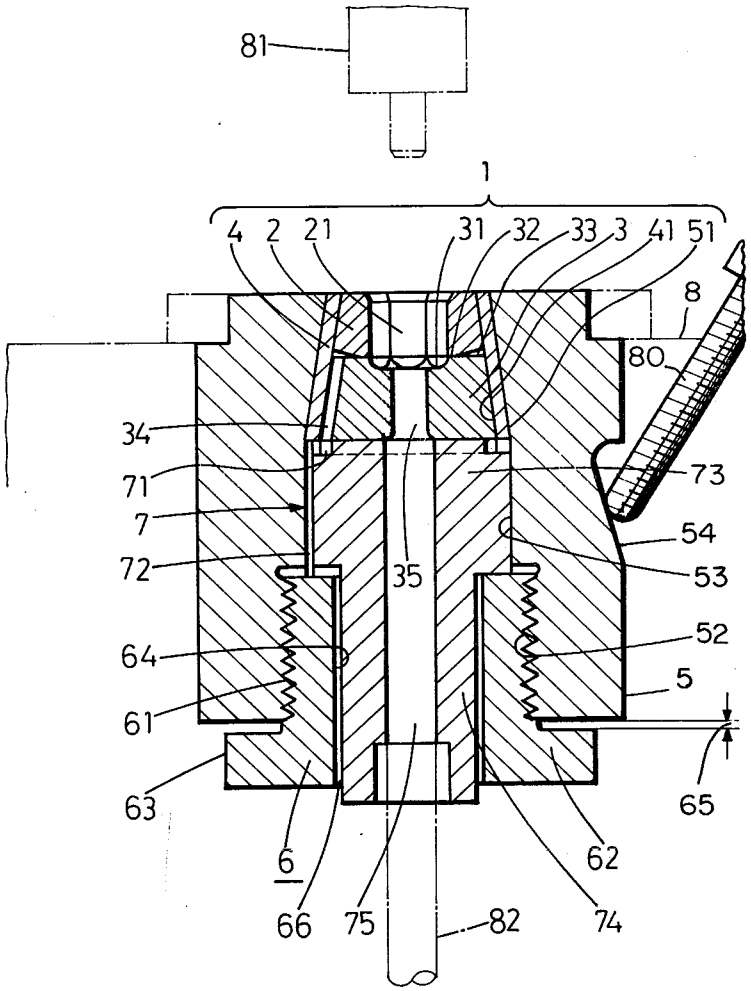
FIG. 2 is a view in vertical section of the die assembly.
Figure 1:
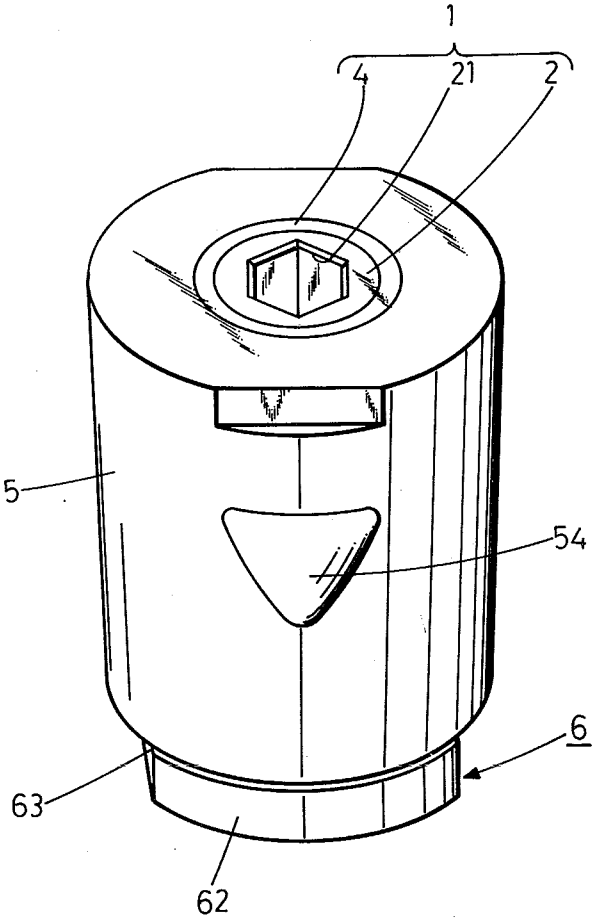
FIG. 1 is a perspective view showing a die assembly of this invention.

The drawings show a die assembly embodying this invention for use in the cold press forming of nuts. The invention is not limited to this embodiment but is similarly applicable to dies for the manufacture of bolts and other mechanical parts.

The die assembly shown comprises a forming die 1, a reinforcement case 5 having fitted therein the forming die 1, a stock die 7 supporting the bottom of the forming die 1, and a pushing-up member 6 holding the stock die 7 in pressing contact therewith. The forming die 1 is in the form of an assembly including an upper die member 2 and a lower die member 3 fixedly fitting in a sleeve 4.

The reinforcement case 5 made of hardened steel of high tensile strength and relatively low hardness has an upwardly tapered bore 51 in its upper center portion, a straight insertion bore 53 under the tapered bore 51, and an internally threaded bored portion 52 of increased diameter extending from the lower end of the insertion bore 53. The sleeve 4 of the forming die 1 is fitted in the tapered bore 51, and the stock die 7 in the insertion bore 53. The pushing-up member 6 is screwed in the threaded bore 52.

To render the sleeve 4 resistant to cracking, the sleeve is made from special steel of lower hardness than the reinforcement case 5. The sleeve 4 has an upwardly tapered outer peripheral surface conforming to the shape of the tapered bore 51 of the reinforcement case 5 and an upwardly tapered opening 41 extending centrally therethrough and conforming to the shape of the tapered outer peripheries of the upper and lower die members 2 and 3. The sleeve 4 intimately fits around the upper and lower die members 2 and 3.

The upper and lower die members 2 and 3 are made of hard material such as cemented carbides and are so tapered and diametrically so dimensioned that they provide an upwardly tapered continuous outer peripheral surface as if they were a single cone.

The upper die member 2 is centrally formed with a hexagonal bore 21 extending therethrough for forming the hexagonal periphery of a nut. The lower die member 3 is formed in its upper surface with a cavity 31 communicating with the bore 21 of the upper die member 2 and adapted to form the top of the nut. The embodiment includes a planar interface 32 at which the upper and lower die members 2 and 3 are in intimate contact with each other and which surrounds the bore 21 and the cavity 31. The outer periphery of the bottom of the upper die member 2 is cut away to provide a clearance 33 surrounding the interface 32. An air vent channel 34 communicating at its upper end with the clearance 33 is vertically formed in the outer side surface of the lower die member 3.

The stock die 7 is made of hardened steel lower in hardness but slightly higher in elasticity than the cemented carbides forming the die members 2 and 3 and harder than the reinforcement case 5. The stock die 7 has a large-diameter cylindrical upper portion 73 fittable in the straight insertion bore 53 of the reinforcement case 5 and a small-diameter lower portion serving as a guide stem 74.

The cylindrical portion 73 is formed in its top surface with a circumferential channel 71 in communication with the air vent channel 34 and has a vertical channel 72 extending axially thereof and communicating with the circumferential channel 71.

The stock die 7 and the lower die member 3 are centrally formed with knockout pin passageways 75 and 35 in communication. The passageway 35 is opened at its upper end to the cavity 31 of the lower die member 3 to render the workpiece releasable from the cavity.

The upper portion of the pushing-up member 6 is in the form of a threaded shank 61 externally threaded for engagement in the threaded bore 52 of the reinforcement case 5. A flange 62 projects from the lower portion of the member 6 over the lower end of the reinforcement case 5. The outer periphery of the flange 62 provides an engagement portion 63 engageable with a turning tool. The pushing-up member 6 has a center bore 64 extending therethrough for the guide stem 74 of the stock die 7 to loosely fit in freely movably.

To assemble the die assembly, the forming die 1 including the upper and lower die members 2 and 3 fixedly fitted in the sleeve 4 is fitted into the reinforcement case 5, the stock die 7 is then inserted into the case 5, and the pushing-up member 6 is manually screwed into the case, causing the member 6 to force up the lower end of the cylindrical portion 73 of the stock die 7 until the member 6 comes to a halt. In this state in which the fastening force is insufficient, the top surfaces of the sleeve 4 and of the upper die member 2 are about 1 mm below the top surface of the reinforcement case 5. Subsequently, the reinforcement case 5 is placed in its inverted position on the table of a press, and the guide stem 74 of the stock die 7 projecting from the center of the pushing-up member 6 is depressed, forcing down the stock die 7 to make the top surfaces of the sleeve 4 and of the upper die member 2 flush with the top surface of the reinforcement case 5. Since the pushing-up member 6 is now free to turn, the member 6 is manually screwed in again while the stock die 7 is being depressed by the press, whereby the parts can be completely assembled. Upon the release of the die assembly from the press, the stock die 7 is relieved of the compression strain, pushing back the member 6, whereby the pushing-up member 6 is tightly held to the reinforcement case 5 in screw-thread engagement therewith free of any loosening. In this state, a slight clearance 65 is provided between the bottom surface of the reinforcement case 5 and the flange 62 of the pushing-up member 6. The lower end of the guide stem 74 of the stock die 7 is in its slightly projected position about 0.1 to 0.3 mm below the flange 62 of the pushing-up member 6.

For press forming operation, the die assembly is placed in the table 8 of a press forming machine and held in place by a set bolt 80 pressed against a side portion 54 of the reinforcement case 5, with a punch 81 positioned above the die assembly and a knockout pin 82 therebelow in alignment with the assembly.

A pre-formed workpiece similar in shape to a finished nut is placed into the bore 21 of the upper die member 2, and the punch 81 is lowered to press-form the piece. At this time, the radial component of the pressure acts on the upper die member 2 and further on the sleeve 4, while the axial component of the pressure is withstood by and acts on the lower die member 3 and is delivered to the table 8 via the stock die 7. The compressed air produced in the cavity 31 during the forming operation escapes through the clearance 33 and vent channels 34, 71 and 72 and is released through the clearance between the threads of the pushing-up member 6 and the reinforcement case 5.

When the upper or lower die member 2 or 3 becomes damaged owing to use, the die members 2 and 3 must be removed from the case 5 along with the sleeve 4 for replacement by a new forming die 1. To remove the damaged die 1 from the reinforcement case 5, the die assembly is first placed in its inverted position on the table of a press as in the assembling procedure, and the guide stem 74 of the stock die 7 slightly projecting from the center of the pushing-up member 6 is depressed by the press to free the pushing-up member. The pushing-up member 6 is therefore smoothly turnable in the reverse direction by a tool fitted to the engagement portion 63. After removing the member 6 from the bottom of the stock die 7, the sleeve 4 is struck on its top, and the stock die 7 and the forming die 1 are withdrawn from the case 5. A new forming die 1 and the stock die 7 are thereafter placed into the case 5, and the pushing-up member 6 is screwed in. The assembly will be ready for use. Since the new forming die 1 includes upper and lower die members 2 and 3 fitted in a sleeve 4 in the specified arrangement, the die members 2 and 3 are replaceable with ease.

According to the invention described above, the pushing-up member 6 in screw-thread engagement with the reinforcement case 5 is not connected to the stock die 7 extending therethrough but permits free movement of the stock die 7, while the stock die 7 has a knockout pin passageway 75 in alignment with the knockout pin passageway 35 of the lower die member 3. Accordingly, the knockout pin passageway 75 can be formed in the center of the stock die 7 independently of the threaded portion 61 formed on the outer periphery of the pushing-up member 6 without the necessity of rendering the knockout pin passageway 75 concentric with the threaded shank portion 61. Even if the passageway 75 is out of alignment with the axis of the threaded shank portion 61 of the pushing-up member 6, no trouble will arise since the stock die 7 is freely movable within the center bore 64 of the pushing-up member 6. Because accurate alignment is not required, the pushing-up member 6 and the stock die 7 are extremely easy to make.

This invention is not limited to the embodiment described above with reference to the drawings. Various changes and modifications may be easily made by those skilled in the art without departing from the spirit of the invention.

Such modifications are therefore included within the scope of this invention.

What I claim is:

1. In a die assembly including a reinforcement case, an upwardly tapered forming die fitting in said case, and a pushing-up member screwed into the lower portion of said reinforcement case to push up said forming die into intimate fitting contact with said reinforcement case, the improvement comprising said pushing-up member threaded into a threaded bore in the lower portion of said reinforcement case and having a center bore extending therethrough, a stock die provided between said forming die and said pushing-up member and having a center bore extending therethrough, a stock die provided between said forming die and said pushing-up member and having an upper surface supporting said forming die in contact with its bottom, said stock die having at its lower portion a guide stem of smaller diameter than said center bore freely movably fitting in the center bore of said pushing-up member, said pushing-up member supporting said stock die and pressing said stock die into intimate fitting contact with said forming die by screw-thread engagement with said reinforcement case.

2. A die assembly as defined in claim 1 wherein said forming die is in the form of an assembly comprising an upper die member and a lower die member fixedly fitting in a sleeve having an upwardly tapered opening.

3. A die assembly as defined in claim 1 wherein the lower end of the guide stem of said stock die slightly projects from the lower surface of said pushing-up member.

4. A die assembly as defined in claim 1 wherein said forming die and said stock die have knockout pin passageways in alignment with each other.

* * * * *